US006902297B1

(12) United States Patent
Fung

(10) Patent No.: US 6,902,297 B1
(45) Date of Patent: Jun. 7, 2005

(54) DECORATIVE LAMP COVER

(76) Inventor: Duncan C. Fung, 611 Walsing Dr., Richmond, VA (US) 23229

( * ) Notice: Subject to any disclaimer, the term of this patent is extended or adjusted under 35 U.S.C. 154(b) by 132 days.

(21) Appl. No.: 10/418,331

(22) Filed: Apr. 18, 2003

Related U.S. Application Data

(63) Continuation-in-part of application No. 10/274,592, filed on Oct. 21, 2002, now Pat. No. 6,746,136.

(51) Int. Cl.[7] ..... F21V 17/04

(52) U.S. Cl. ..... 362/255; 362/311; 362/153; 362/351; 362/124; 362/808

(58) Field of Search ..... 362/311, 145, 152, 362/255, 153, 153.1, 351, 124, 806, 808

(56) References Cited

U.S. PATENT DOCUMENTS 5,911,501 A * 6/1999 Katz ..... 362/267
6,000,820 A * 12/1999 Murray ..... 362/441
6,554,443 B2 * 4/2003 Fan ..... 362/96
6,746,136 B1 * 6/2004 Fung ..... 362/255

* cited by examiner

*Primary Examiner*—Laura K. Tso

(57) ABSTRACT

A lamp cover comprising a hollow shell having an exterior surface in the form of a decorative shape and an interior surface having pliant ribs extending inwardly from the interior surface, which ribs are of a size and shape as to frictionally engage the exterior of a light fixture lens, bulb cover or bulb. According to a preferred embodiment, the lamp cover is fabricated from a pliable and high temperature resistant polymeric material that permits its close contact with a low voltage or conventional light bulb. According to further alternative preferred embodiments, the hollow pliant shell is translucent, portions of the hollow pliant shell are made opaque and the hollow pliant shell is colored. A lamp cover base assembly for attachment of a variety of decorative lamp covers to lamps and lamp bases is also described.

16 Claims, 11 Drawing Sheets

DECORATIVE LAMP COVER

This application is a continuation-in-part of U.S. patent application Ser. No. 10/274,592 filed, Oct. 21, 2002, now U.S. Pat. No. 6,746,136.

FIELD OF THE INVENTION

The present invention relates to lamp shades or covers and more particularly to such devices for primarily exterior lighting applications that are durable, readily interchangeable and fashionably decorative.

BACKGROUND OF THE INVENTION

Decorative exterior lighting, for example along walkways, driveways and in garden areas, has become very popular. Such lighting can be low voltage, i.e. 12/24 volts driven by a transformer or solar powered, or 110 volts (in the U.S.). Low voltage lighting produces relatively small amounts of heat and thus is low temperature, while the more conventional incandescent lighting produces significant heat and higher temperatures, on the order of several hundred degrees Fahrenheit. The latter situation is particularly prevalent in the case of pole lighting fixtures and sconces such as are used on either side of doors.

Similarly, the use of "theme" decorations around homes during the different festive seasons of the year, e.g. Halloween, Thanksgiving, Christmas, etc., is also common. It has therefore been found desirable to use existing exterior lighting fixtures as the basis for the installation of such theme decorations at the appropriate times of the year.

Until the present time, most such decorative devices associated with, for example, exterior lighting as described above, have comprised inexpensive lamp shades or covers fabricated from paper or inexpensive plastics that are designed to surround the entire lighting fixture at a safe distance so as not to expose the shade or cover to heat from the lighting device. Such prior art devices are, largely because of their materials of fabrication, not sufficiently weather, UV, etc. resistant as to be satisfactorily used more than about one season before disposal. Additionally, because of their design to surround the entire fixture much like a sack or bag, (due to the large number of differing shapes and designs of such lighting fixtures) their location upon the lighting fixture can be disturbed by, for example, wind thereby disrupting their decorative value.

It would therefore be desirable to have decorative covers or shades for, for example, exterior lighting that provide easy interchangeability without the use of tools and secure attachment to such lighting fixtures while being fabricated from materials that exhibit superior UV, weather, etc. resistance thereby providing many years of useful service.

OBJECTS OF THE INVENTION

It is therefore an object of the present invention to provide a durable and highly decorative lamp cover for, for example, exterior lighting devices that is readily interchangeable, heat, weather and UV resistant and that can be safely and securely attached to both high and low voltage lighting systems.

SUMMARY OF THE INVENTION

According to the present invention, there is provided a lamp cover comprising a hollow pliant shell having an exterior surface in the form of a decorative shape and an interior surface having pliant ribs extending inwardly from the interior surface, which ribs are of a size and shape as to frictionally engage the exterior of a light fixture lens, bulb cover or bulb. According to a preferred embodiment, the lamp cover is fabricated from a pliable and high temperature resistant polymeric material that permits its close contact with a low voltage or conventional light bulb.

DESCRIPTION OF THE DRAWINGS

The invention will be best understood when the following detailed description is read in light of the accompanying drawings wherein like numerals refer to like features and wherein.

DETAILED DESCRIPTION

Figure 1:
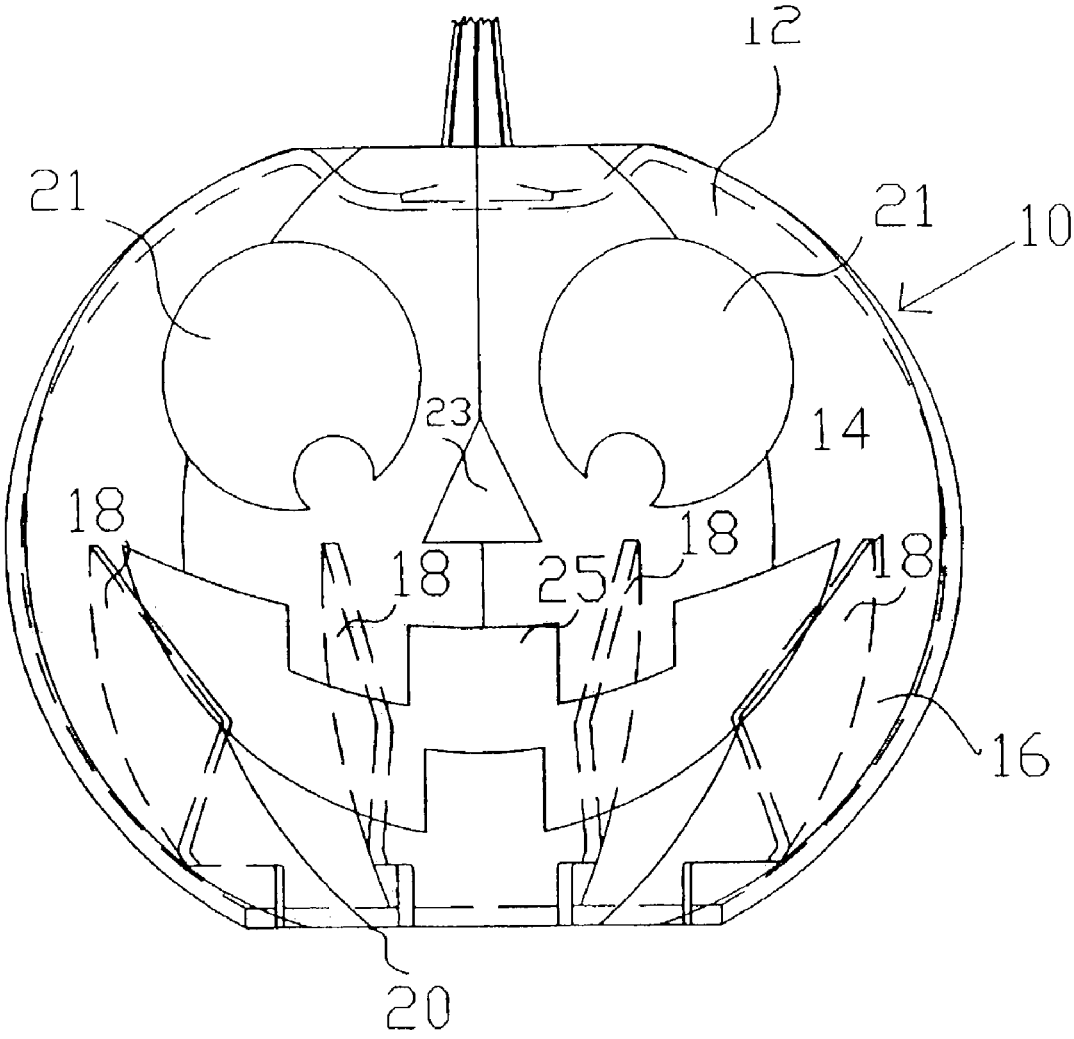
FIG. 1 is a partially phantom front view of one embodiment of the lamp cover of the present invention.
Figure 1A:
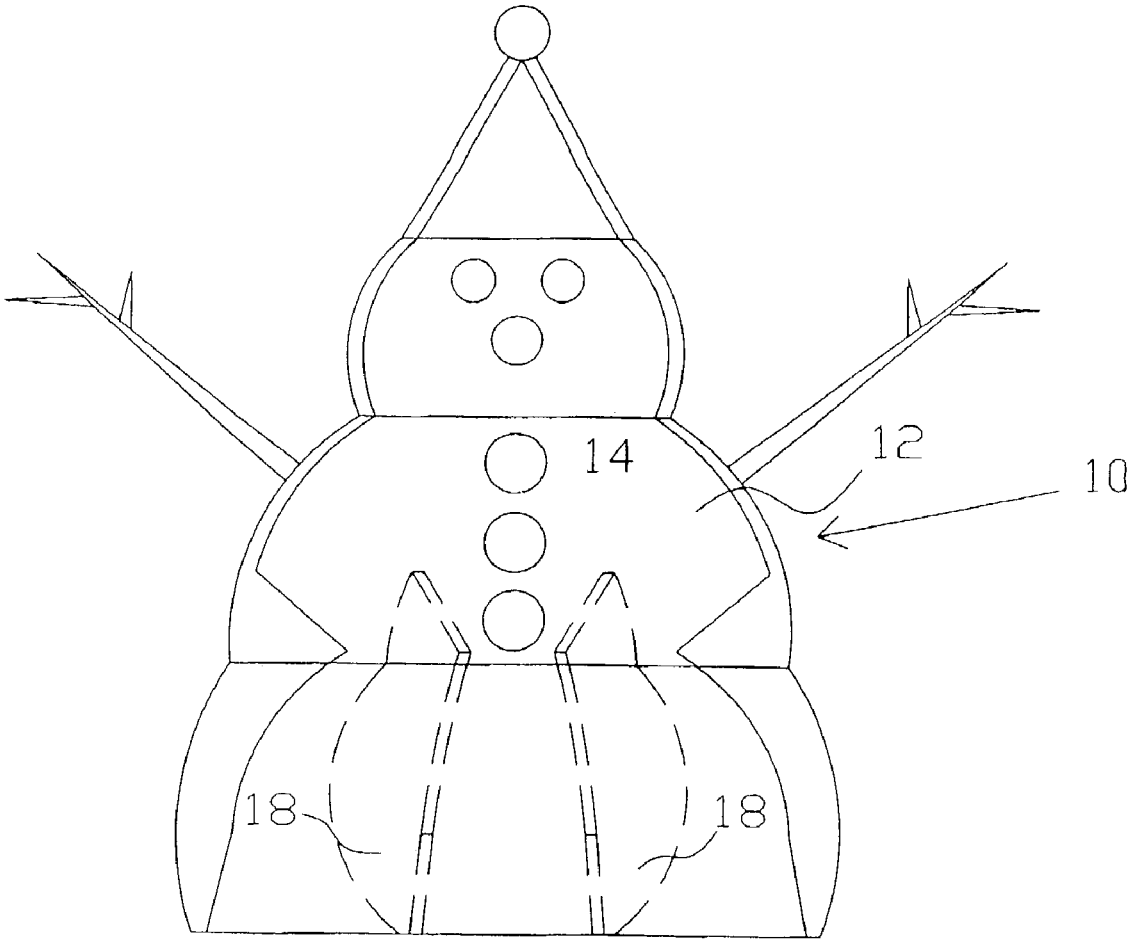
FIG. 1A is a partially phantom front view of another embodiment of the lamp cover of the present invention.
Figure 2:
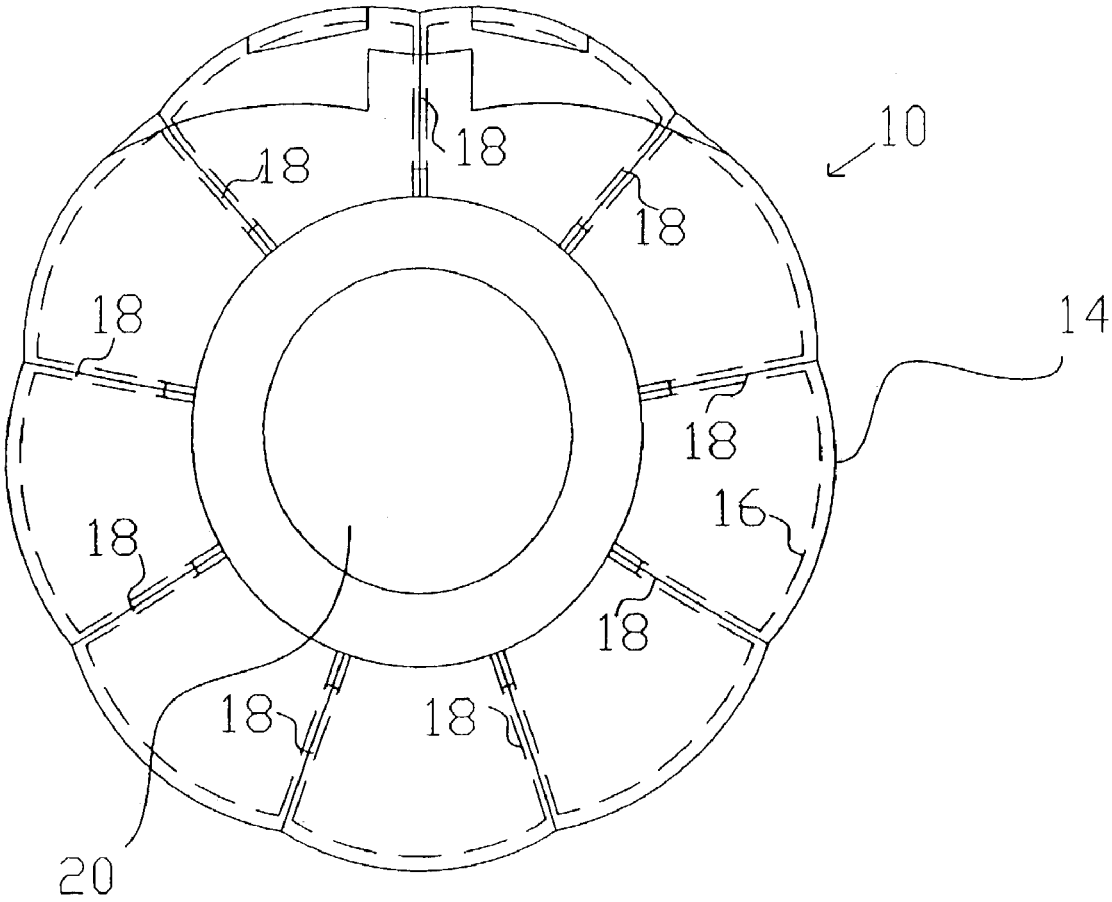
FIG. 2 is a bottom view of the embodiment depicted in FIG. 1.

Referring now to FIGS. 1, 1A and 2, the lamp cover 10 of the present invention comprises a hollow pliant shell 12 having an exterior surface 14 that provides some type of decorative shape, in the case of FIG. 1 a "pumpkin" or "jack-o-lantern" of the type used in Halloween decorations and in the case of FIG. 1A a snowman of the type that would be used for a Christmas or winter decoration. As will be described in greater detail hereinafter, lamp cover 10 is preferably at least partially translucent and partially opaque to permit proper display of the exterior decorative shape and details thereof when applied to a lighting fixture as described below. According to the embodiment depicted in FIGS. 1, 2 and 4–7 lamp cover 10 also has an interior surface 16 from which extend inwardly a plurality of pliant ribs 18 whose purpose, as described below, is to engage a light bulb, lens, globe or lighting fixture to which lamp cover 10 is applied through insertion of the light bulb or lighting fixture through aperture 20 in the bottom of lamp cover 10. The term "pliant" as used herein to describe the various elements of lamp cover 10 is meant to mean that the elements are bendable or flexible while of sufficient structural strength as to retain their shape unless pressure is applied thereto to deform them. Additionally, while it is preferred that hollow pliant shell 12 and pliant ribs 18 be fabricated from the same material for ease of fabrication as described below, it is contemplated that the hollow pliant shell and the pliant ribs could be fabricated from dissimilar pliant materials.

As alluded to above, it is preferred in many applications that while the bulk of lamp cover 10 be translucent, that certain portions thereof be opaque. This is perhaps best exemplified in the case of the embodiment depicted in FIG. 1 wherein the eyes 21, nose 23 and mouth 25 of the "jack-o-lantern" shape depicted in FIG. 1 be made opaque by the application of, for example, paint or some other suitable opacifying agent in these areas so as to project the properly defined image when lamp cover 10 is applied over a lighting fixture or bulb as described below. While it is not critical to the successful practice of the present invention, it is also preferred that areas such as 21, 23 and 25 be recessed into outside surface 12 of lamp cover 10 as perhaps best shown in the case of eyes 21, for example, in FIG. 8.

Figure 3:
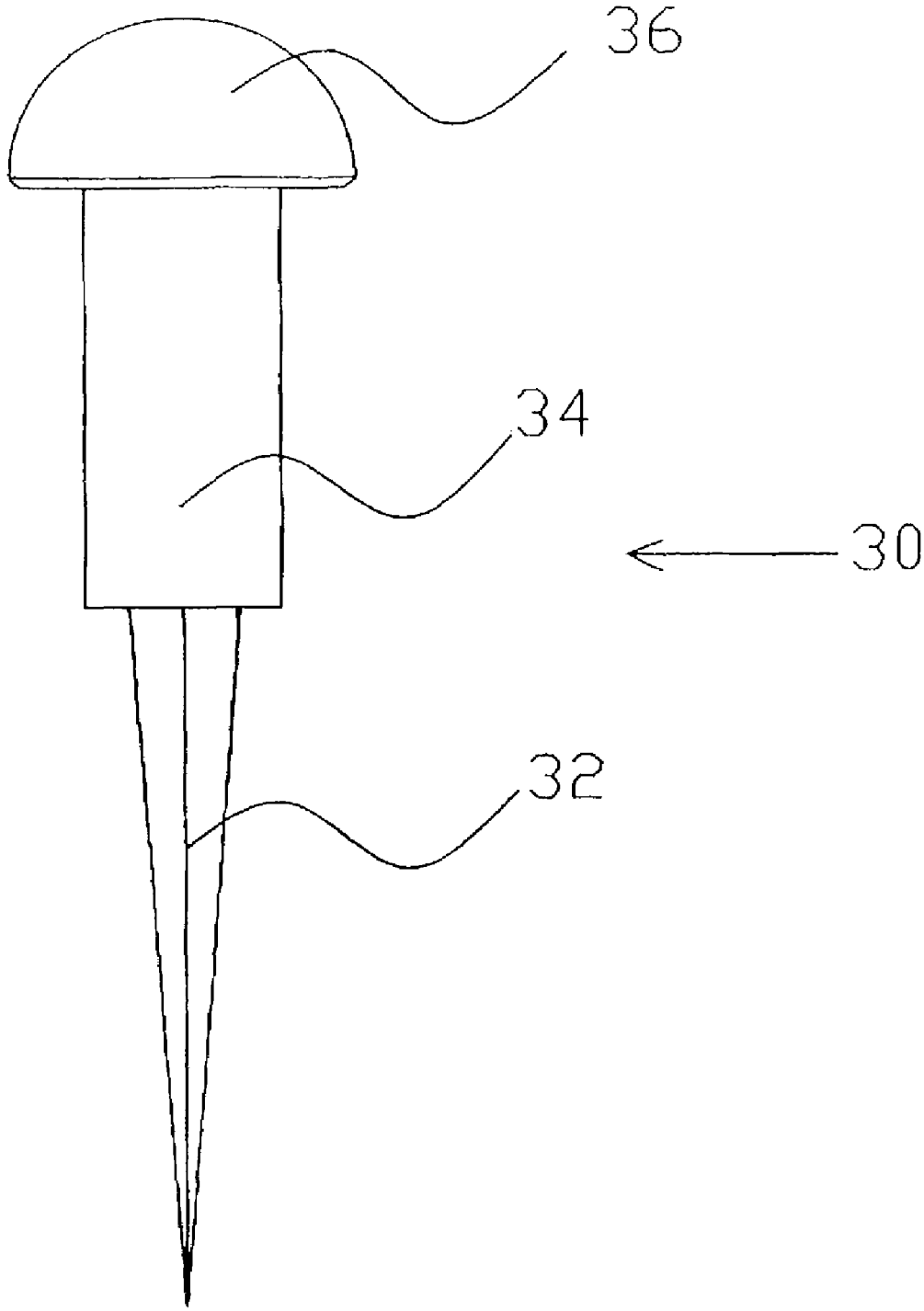
FIG. 3 is an elevational view of one type of lighting fixture to which the lamp cover of the present invention can be applied.
Figure 4:
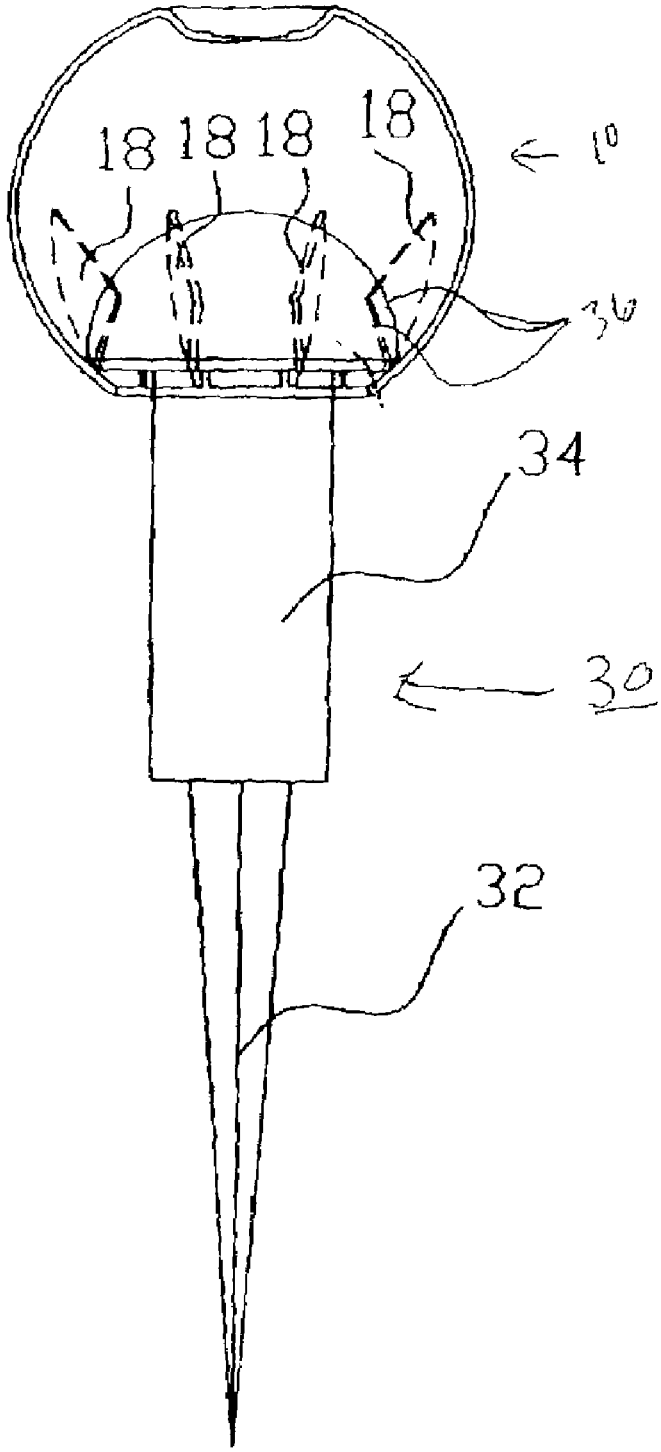
FIG. 4 is a partially phantom rear view of the embodiment of the lamp cover of the present invention depicted in FIG. 1 applied to the lighting fixture depicted in FIG. 3.

Shown in FIG. 3 is a so-called "mushroom" lighting fixture 30 of a type commonly used for exterior lighting along the edges of walkways, driveways, etc. The essential elements of lighting fixture 30 are a stake portion 32 for insertion into the ground, a socket 34 and a mushroom-shaped cap or lens 36 whose purpose is to diffuse light produced by the enclosed light bulb (not shown in FIG. 3) and to give it a "mushroom" shape. As shown in FIG. 4, according to one embodiment of lamp cover 10 of the present invention is applied to lighting fixture 30 by application of lamp cover 10 over mushroom-shaped cap or lens 36 by insertion of mushroom-shaped cap or lens 36 into aperture 20 in the bottom of lamp cover 10 and engagement of custom fabricated ribs 18 with mushroom-shaped cap or lens 36. When thus applied over mushroom-shaped cap or lens 36, light emanating from mushroom-shaped cap or lens 36 is transmitted through the translucent portions of lamp cover 10 while the opacified portions, for example areas 21, 23 and 25 of FIG. 1, do not transmit light. In this fashion, the image of a "jack-o-lantern" is replicated at each lighting fixture 30 to which lamp covers 10 are applied. For clarity, features 21, 23 and 25 have not been shown in FIGS. 4–7, however, their location and purpose will be readily apparent to the skilled artisan reading this description, and the location and topography of specific eye area 21 as it relates to surface 12, depicted clearly in FIG. 8.

Figure 5:
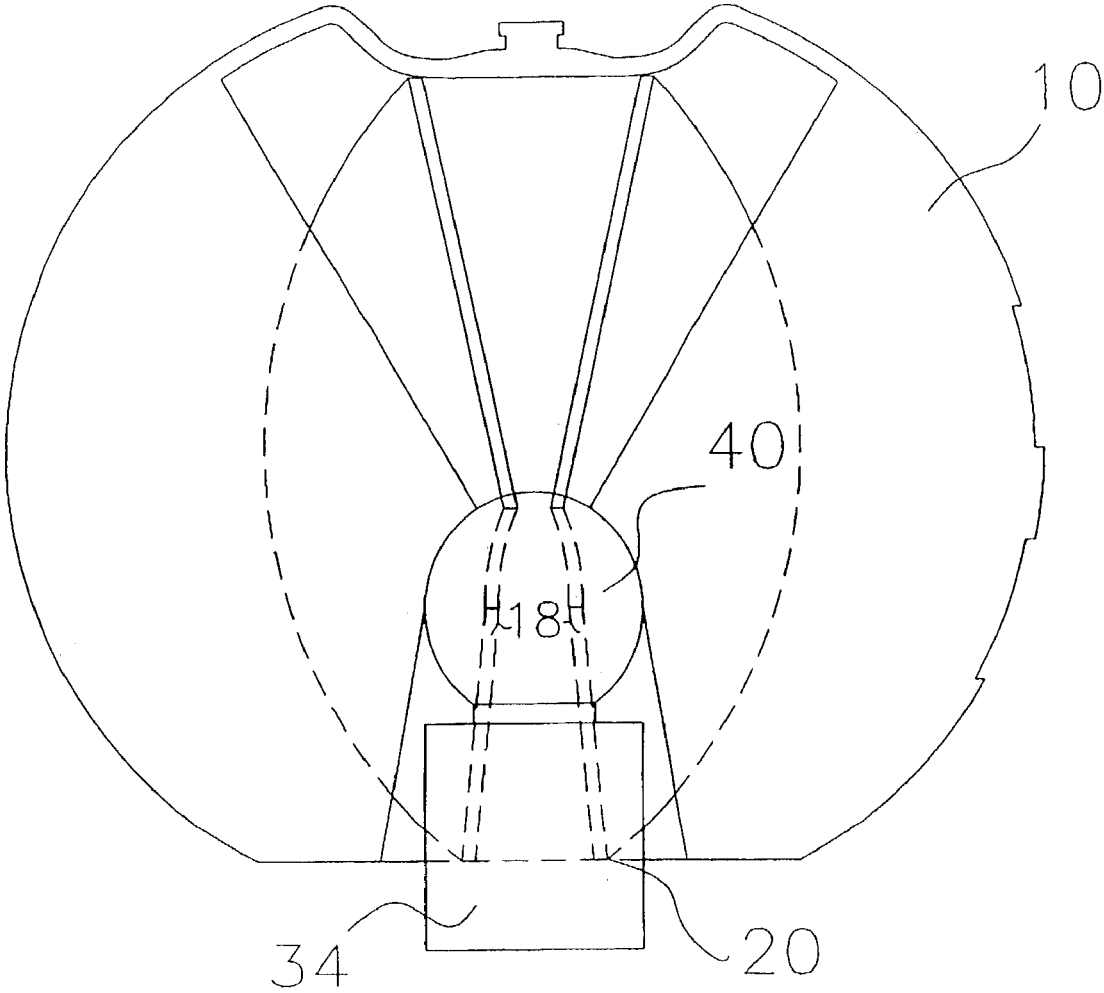
FIG. 5 is a partially phantom rear view of the embodiment of the lamp cover of the present invention depicted in FIG. 1 applied directly to a low voltage bulb inserted into a suitable lighting fixture.

In the embodiment depicted in FIG. 5, lamp cover 10 of FIG. 1 is applied directly to a low voltage light bulb 40 with inwardly extending ribs 18 engaging the outer surface of low voltage bulb 40, after, in certain instances, socket 34 and low voltage bulb 40 having been inserted through aperture 20. In most instances, it is not necessary that socket 34 be inserted though aperture 20, but it may be so inserted depending upon circumstances or the design of the particular lighting fixture to which lamp cover 10 is applied.

Figure 6:
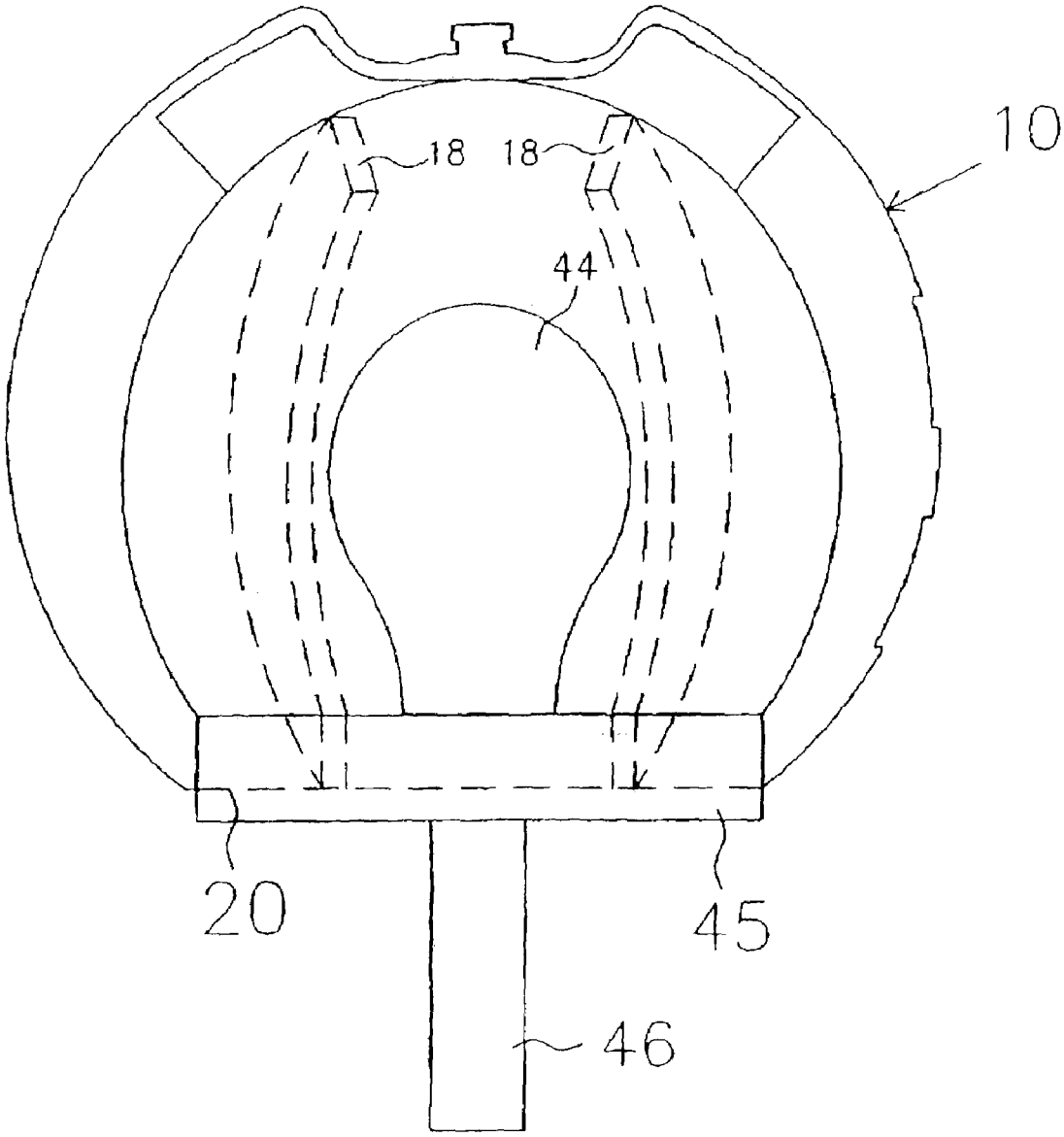
FIG. 6 is a partially phantom rear view of the lamp cover of the present invention depicted in FIG. 1 applied to a globe of the type used to surround a conventional incandescent lamp inserted into a suitable lighting fixture.

Similarly, as shown in FIG. 6 because of the character of the materials of fabrication of lamp cover 10 as described in detail below, lamp cover 10 can be applied to a globe 42 that surrounds a conventional incandescent bulb 44 contained in a socket 43 through the engagement of ribs 18 with the exterior surface of globe 42.

Figure 7:
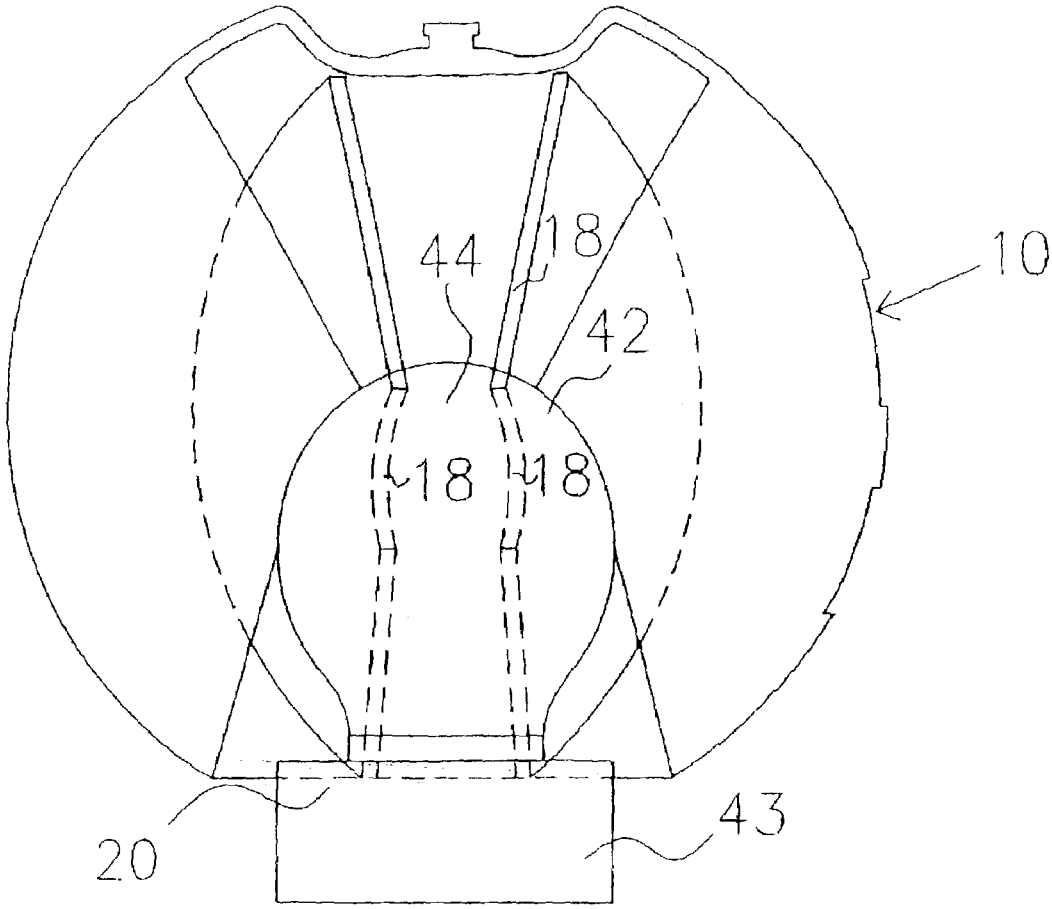
FIG. 7 is a partially phantom rear view of the lamp cover of the present invention depicted in FIG. 1 applied directly to an incandescent light bulb inserted into a suitable lighting fixture.

In yet a further embodiment of the lamp cover of the present invention depicted in FIG. 7, lamp cover 10 is placed over incandescent bulb 44 through the insertion of bulb 44, mounting member 46 and socket 45 through aperture 20 in lamp cover 10. In this embodiment, ribs 18 engage directly, incandescent lamp 44.

As will be apparent to the skilled artisan, pliant ribs 18 in each of the foregoing embodiments may have a different configuration depending upon the particular lighting fixture or bulb structure with which they will be required to engage. Since it is contemplated that in one of its claimed embodiments, lamp cover 10 will be packaged with a specific fixture such customization of the shape of pliant ribs 18 is relatively simple. In other embodiments, because of the relative uniformity of low voltage and conventional incandescent bulbs, the problem of rib customization is not particularly difficult. In many instances, because of the high degree of pliability of the preferred materials of fabrication described below, the shape of pliant ribs 18 can vary widely but still be such as to engage a broad variety of lighting fixture structures without significant customization.

While in those instances, for example that depicted in FIG. 5, where pliant ribs 18 engage a relatively low temperature low voltage bulb 40, lamp cover 10 can be fabricated from a variety of pliant polymeric materials, in those instances, for example that depicted in FIGS. 6 and 7, where lamp cover 10 is exposed to the relatively high temperatures produced by conventional incandescent bulbs, lamp cover 10 is preferably fabricated from a pliable high temperature polymer as described below.

Figure 9:
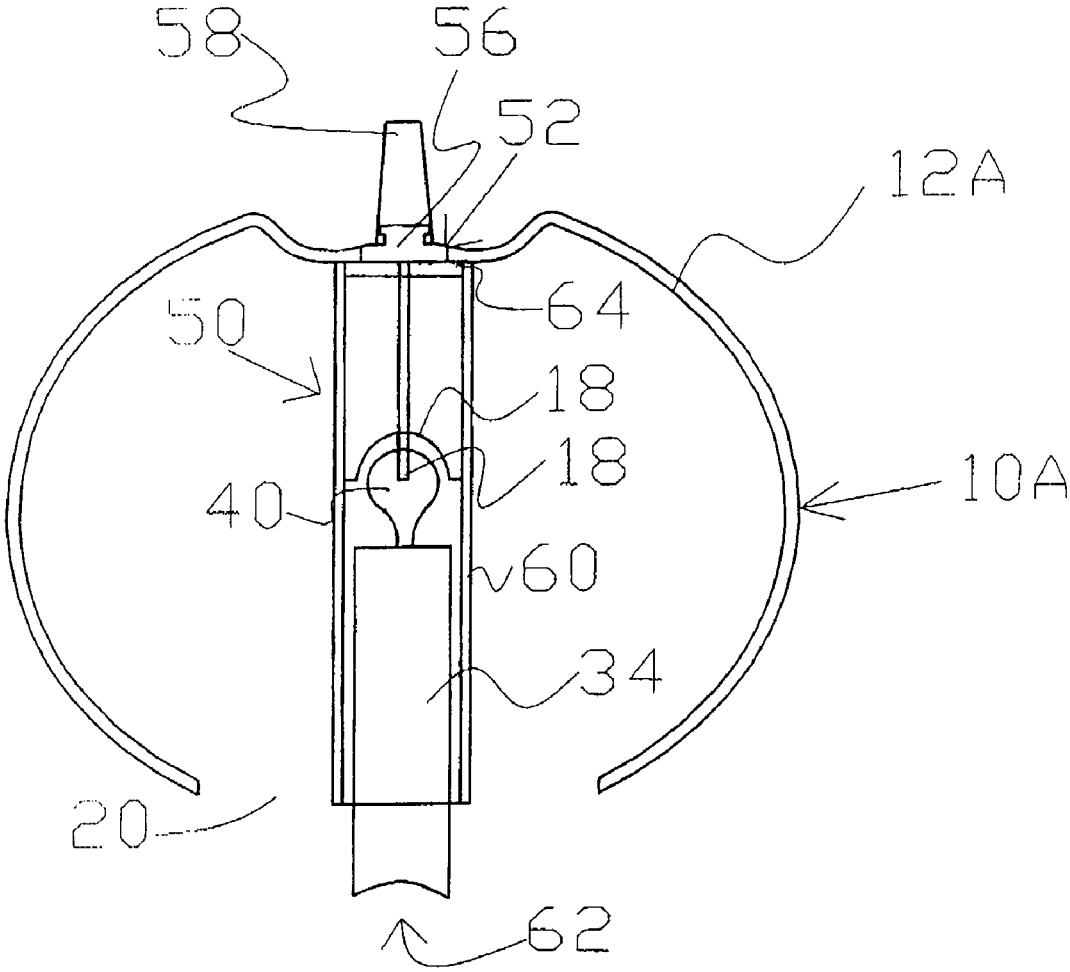
FIG. 9 is a cutaway side view of one embodiment of the lamp cover of the present invention.
Figure 10:
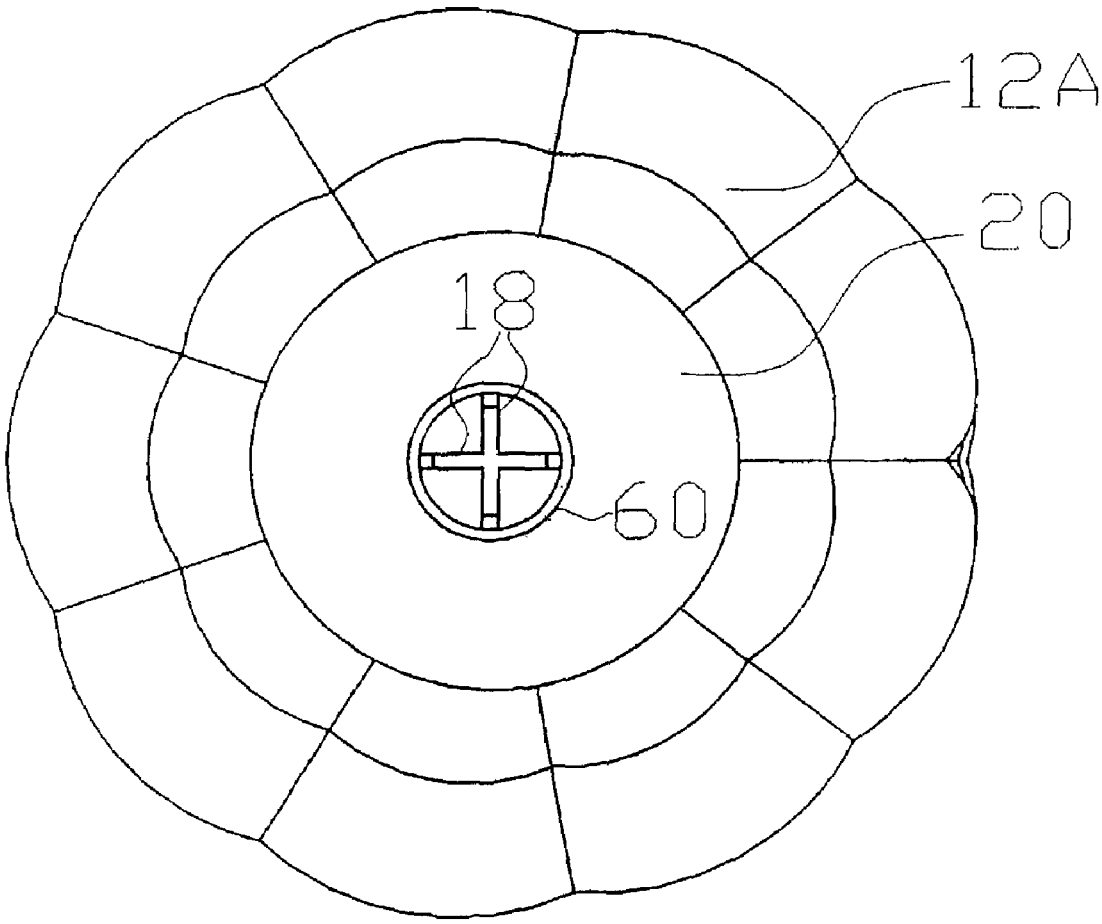
FIG. 10 is a bottom view of one embodiment of the lamp cover of the present invention.

Referring now to FIG. 9 that depicts yet another embodiment of the lamp cover 10A of the present invention, lamp cover 10A is assembled upon a cylindrical lamp cover base assembly 50. In accordance with this embodiment, lamp cover 10A comprises shell 12A that may and preferably does have an aperture 52 in the top 54 thereof through which can be inserted a tab 56 or the like that can serve as an attachment point for, for example, a pumpkin stem 58 or the like, depending upon the particular shape or configuration of shell 12. Such an arrangement allows for the secure attachment of shell 12A to lamp cover base 50 through the mechanism of stem 58 or the like serving as a "snap" or other securing fitting.

As best seen in FIG. 9, it is lamp cover base assembly 50 that provides a broad range of lamp cover attachment options and which forms an important aspect of the lamp cover system of the present invention. Lamp cover base assembly 50, as previously described comprises a cylindrical core 60, open at one end 62 and closed at the other end 64. Internal to lamp cover base assembly 50 cylindrical core 60 proximate closed end 64 are preferably pliant orthogonal ribs 18 which like ribs 18 previously described in connection with FIGS. 1–3, etc. serve to engage a light bulb 40 over which shell 12A is installed by passage of aperture 20 over the base of a light fixture 34 as shown in FIG. 5. In this instance, however, it is cylindrical core 60 that directly engages light fixture 34 with ribs 18 directly engaging light bulb 40. In the embodiment depicted in FIG. 9 light bulb 40 is a low voltage bulb of perhaps between about 5 and 24 volts depending upon the particular lighting system utilized. In this alternative configuration, cylindrical core 60 is firmly and securely attached to light fixture 34. Similarly, associated and attached shell 12 of lamp cover 10 is also firmly and securely attached to cylindrical core 60 and light fixture 34 through the mechanism of tab 56 previously described.

Figure 8:
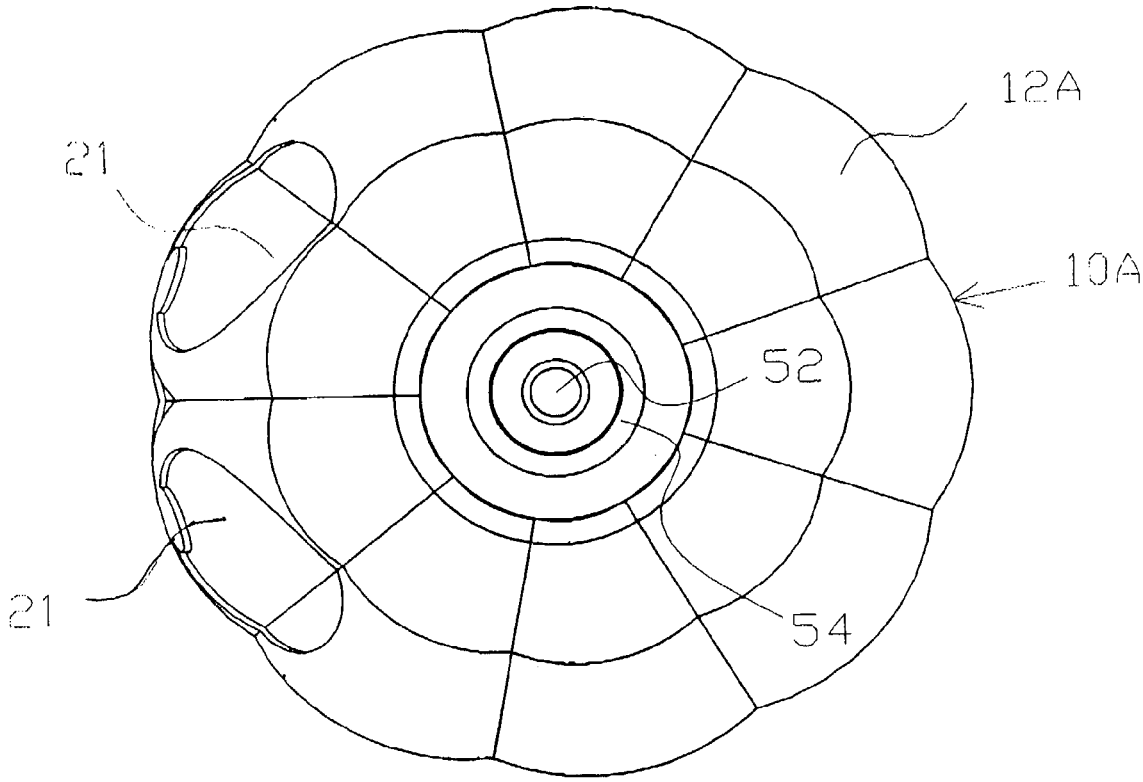
FIG. 8 is a top plan view of one embodiment of the lamp cover of the present invention showing recesses for the addition of coloring or other agents.

While as described hereinabove, lamp cover base assembly 50 is described as a separate and distinct element from shell 12A of lamp cover 10, it will be apparent to the skilled artisan that using the materials of construction described below, or similar readily molded or formed materials, that lamp cover base assembly 50 can be formed as an integral part of shell 12A and the entire assembly of elements 12A and lamp cover base assembly 50 formed as a single integral unit with, as in the case depicted in FIG. 8, even stem 58 being an integral part of the entire assembly. The advantage of lamp cover base assembly 50 being a separate element from shell 12A, for example, is, however, that a single lamp cover base assembly 50 can be attached to light fixture 34 and bulb 40 and a variety of shells 12 interchangeably attached thereto without the need to remove cylindrical core 60 from light fixture 34 through the use of tab 56 or a similar shell attachment mechanism. The advantages of such ready interchangeability will be readily apparent to those skilled in the arts to which this invention pertains.

Similarly, while lamp cover base assembly 50 is described hereinabove as having an open end 62 and a closed end 64, it will be readily apparent to the skilled artisan that closed end 64 could incorporate one or more apertures that might serve as vents for the release of heat produced by an incorporated light bulb 40.

According to a preferred embodiment of the present invention, lamp cover 10 is fabricated by molding, injection molding, blow molding, etc. a high temperature resistant silicone polymer or silicone rubber. Such materials are commonly available as liquids or gums suitable for fabrication as just described and exhibit temperature capabilities upwards of 200° C., which is adequate for direct exposure to the temperatures produced by a conventional incandescent bulb. Additionally, these materials are very pliant and very good electrical insulators, thus protecting the user from the danger of electrical shock in the applications described herein. Furthermore, these materials are weather resistant, thus making the lamp covers of the present invention suitable for outdoor use and extremely durable providing that they can be used for many years.

Such silicone polymers and silicone rubbers are of the type commonly used in such applications as rubber stoppers, industrial packaging, diaphragms, rollers etc., and demonstrate percent elongations in the range of about 300 to about 400 percent. These materials are easily colored through the use of conventional pigments and coloring agents, and such coloring techniques are well known to those skilled in the art of molding such materials. This ability to be colored is of particular value in the lamp covers of the present invention as, for example in the case of the "jack-o-lantern" depicted in FIG. 1, where the hollow pliant shell can be colored orange to mimic the color of a pumpkin while in the case of the shape depicted in FIG. 1A the hollow pliant shell can be colored principally white to project the image of a snowman. In the embodiment depicted in FIG. 1, eyes 21, nose 23 and mouth 25 could be rendered opaque using a black or other paint applied to the outer surface of hollow pliant shell 12 to properly project the image desired.

A particularly preferred class of silicone polymers are those supplied under the trademark Winthane™ Silicone elastomers that are available from Winfield Industries, 852 Kensington Ave., Buffalo, N.Y. 14215 as liquids and when fabricated retain their physical properties over a very wide range of working temperatures, minus 60° C.–+230° C. Fabrication of lamp cover 10 from pliant materials such as these further simplifies the insertion of the lighting fixture or portions thereof through aperture 20 in the bottom of lamp cover 10.

There has thus been described a novel decorative lamp cover suitable for the interchangeable (without the use of tools) decoration of lighting fixtures with the change of festive seasons or holidays. The lamp cover of the present invention provides a weather resistant, temperature resistant and durable decorative element that can be used for many years and in differing locations.

While the invention has been described largely in the context of flexible unitized shells having pliant interior ribs, it will be apparent to the skilled artisan that the basic concept can be expanded upon with very little substantial modification. For example, the lamp cover of the present invention could be fabricated from metal, stone, etc. With translucency provided in cutouts in those areas described hereinabove as preferably opaque and opacity provided in those areas previously described as translucent due to the inherent opacity of the material of fabrication. Thus, a pumpkin shape as depicted in FIG. 1 could be provided with eyes 21, nose 23 and mouth 25 all cut out of a metallic or stone shell. In such an instance, ribs 18 extending from the interior surface of shell 12 interior surface could be of the same or different materials. If of the same material as that of shell 12 as just described, ribs 18 might or might not be pliant or only limitedly pliant depending upon the material of fabrication. For example, if shell 12 is fabricated from a metal such as steel ribs 18 could be rigid instead of pliant and custom made to accommodate their engagement with a specific bulb or globe configuration. Alternatively, if shell 12 were made of steel, ribs 18 could still be pliant by fabrication thereof from a suitable rubber or polymeric material that was adhered or otherwise attached to the interior surface of shell 12. Thus, a wide variety of variations and modifications of the invention described herein are possible and contemplated by the inventors hereof.

As the invention has been described, it will be apparent to those skilled in the art that the same may be varied in any ways without departing from the spirit and scope thereof. Any and all such modifications are intended to be included within the scope of the appended claims.

What is claimed is:

1. A decorative lamp cover comprising:

A) a hollow pliant shell having an exterior surface, an interior surface, a bottom and an aperture in said bottom, said aperture adapted to engage a light fixture or light fixture lens inserted through said aperture; and B) a plurality of pliant ribs extending from said interior surface arranged to engage a light bulb or light fixture lens inserted through said aperture.

2. The decorative lamp cover of claim 1 wherein portions of said hollow pliant shell are opaque.

3. The decorative lamp cover of claim 1 fabricated from a high temperature resistant polymeric material.

4. The decorative lamp cover of claim 3 wherein said polymeric material is stable at a temperature in excess of 200° C.

5. The decorative lamp cover of claim 4 wherein said high temperature resistant polymeric material is selected from the group consisting of silicone polymers and silicone rubbers.

6. The decorative lamp cover of claim 1 wherein said hollow pliant shell is colored.

7. In combination,

A) a lighting fixture comprising a lamp base and a light bulb inserted into said lamp base;

B) a lamp cover base assembly comprising a cylindrical core having an open end for engagement with said lamp base and a closed or partially closed end opposite said open end and said closed or partially closed end incorporating ribs for engagement with said light bulb when said cylindrical core engages said lamp base; and C) attached to said lamp cover base assembly a decorative lamp cover comprising a hollow shell that surrounds said lamp base, said light bulb and said lamp base cover.

8. The combination of claim 7 wherein said hollow shell is translucent.

9. The combination of claim 8 wherein portions of said hollow shell are rendered opaque.

10. The combination of claim 7 wherein said decorative lamp cover is fabricated from a high temperature resistant material.

11. The combination of claim 10 wherein said polymeric material is stable at temperatures in excess of 200° C.

12. The combination of claim 10 wherein said high temperature resistant polymeric material is selected from the group consisting of silicone polymers and silicone rubbers.

13. The combination of claim 7 wherein said decorative lamp cover is integrally formed with said lamp cover base assembly.

14. The combination of claim 7 wherein said decorative lamp cover is temporarily attached to said lamp cover base.

15. The combination of claim 14 wherein said hollow shell includes an aperture at the top thereof, said lamp cover base assembly includes an attachment mechanism that inserts through said hollow shell aperture when said hollow shell is placed over said lamp cover base assembly thereby permitting attachment of a securing mechanism to said attachment mechanism for purposes of holding said hollow shell and said lamp cover assembly together as a unit.

16. A lamp cover base assembly comprising a cylindrical core having an open end for engagement with a lamp base inserted therein and a closed or partially closed end opposite said open end and incorporating ribs for engagement with a light bulb in said bas when said cylindrical core engages said lamp base.

* * * * *